United States Patent [19]

Semmler et al.

[11] 4,118,290

[45] Oct. 3, 1978

[54] PROCESS FOR THE PREPARATION OF PERFLUOROETHYL IODIDE

[75] Inventors: Hans-Joachim Semmler, Hochheim, Main; Bernd Felix, Burghausen, Salzach, both of Fed. Rep. of Germany

[73] Assignee: Hoechst Aktiengesellschaft, Frankfurt am Main, Fed. Rep. of Germany

[21] Appl. No.: 775,847

[22] Filed: Mar. 9, 1977

[30] Foreign Application Priority Data

Mar. 11, 1976 [DE] Fed. Rep. of Germany ..... 2610148

[51] Int. Cl.[2] ..... C25B 3/08; C07C 17/10

[52] U.S. Cl. ..... 204/59 F; 260/653.8

[58] Field of Search ..... 204/59 F

[56] References Cited

U.S. PATENT DOCUMENTS

| | | | |
|---|---|---|---|
| 2,519,983 | 8/1950 | Simons | 204/59 F |
| 3,737,470 | 6/1973 | Cottle | 204/59 F |

FOREIGN PATENT DOCUMENTS

| | | | |
|---|---|---|---|
| 1,084,130 | 1/1955 | France | 204/59 F |

*Primary Examiner*—F.C. Edmundson

*Attorney, Agent, or Firm*—Curtis, Morris & Safford

[57] ABSTRACT

Perfluoroethyl iodide is prepared from an agitated mixture of tetrafluoro-diiodoethane and hydrogen fluoride by means of electrolysis. Preferably the temperature is in the range of from −15° C to +19° C and the voltage in the range of from 4 to 6 V.

6 Claims, No Drawings

PROCESS FOR THE PREPARATION OF PERFLUOROETHYL IODIDE

The present invention relates to a process for the preparation of perfluoroethyl iodide.

The subject of the present invention is a process for the preparation of perfluoroethyl iodide from tetrafluoroethylene. Together with tetrafluoroethylene, perfluoroethyl iodide serves for the preparation of valuable higher-molecular-weight fluorine compounds. It has so far been obtained by the reaction of iodopentafluoride with iodine and tetrafluoroethylene. In this process the iodopentafluoride must be prepared in a separate step from iodine and elementary fluorine. However, the transport and handling of elementary fluorine are inconvenient. It is also possible to react elementary fluorine directly with tetrafluorodiiodoethane to give perfluoroethyl iodide. Attempts have also been made to prepare perfluoroethyl iodide in anhydrous hydrofluoric acid, while using other oxidizing agents, for example, chloric or oxygen acids. However, these processes involve great problems due to corrosion.

The objective has therefore been to avoid the drawbacks of the known processes and to prepare perfluoroethyl iodide without using other oxidizing agents, especially without the use of elementary fluorine.

A process has now been found to prepare perfluoroethyl iodide from tetrafluoro-diiodoethane and hydrogen fluoride, which comprises electrolyzing a mixture of anhydrous hydrofluoric acid and tetrafluoro-diiodoethane at a voltage in the range of from 3 to 8.5 V.

In this process, the electrolysis of the tetrafluoro-diiodoethane in comprises continuously hydrofluoric acid is preferably carried out in electrolysis cells having a common anode and cathode chamber according to Simons (cf. German Patent Specification No. 817,151 and U.S. Patent Specification No. 2,519,983).

The tetrafluoro-diiodoethane used may be prepared according to known processes. For example, a mixture of iodine and tetrafluoro-diiodoethane can be reacted with tetrafluoroethylene in an autoclave, while stirring. The tetrafluoro-diiodoethane introduced serves as solvent and promotes the reaction process.

The electrolysis process of the invention is carried out at a voltage in the range of from about 3 to about 8.5 V, especially from 4 to 6 V. The electrolyte consists of a mixture of tetrafluoro-diiodoethane and hydrofluoric acid. Its minimum temperature should be approximately −15° C; on the other hand the pressure and temperature should be chosen in such a range that the hydrofluoric acid is still present in the liquid phase. The maximum temperature is preferably 19° C.

The electrolysis cell should consist of materials which are stable towards hydrofluoric acid. There may be mentioned, for example, VA steels, nickel, copper and polypropylene. In order to increase the effective surface of the hydrolysis, the electrodes are advantageously designed as electrode bundles.

The distance between the anode and the cathode may vary within a wide range, distances between 1.5 and 15.0 mm being advantageous. Particularly useful are distances between 3.0 and 6.0 mm. The anodes and cathodes may be prepared from nickel. Besides, for the cathode there may also be successfully used other metals, for example iron. Due to reasons based on manufacture, the thickness of the electrode plates should be in the range of from about 0.5 to 3 mm.

At low temperatures, tetrafluoro-diiodoethane is practically insoluble in anhydrous hydrofluoric acid. In order to obtain an intimate mixture of the two substances, an intensive agitation of the electrolyte is required. This helps at the same time to prevent tetrafluoro-diiodoethane from depositing and to establish the contact of this compound with the anode. Therefore, the possibility of thorough stirring or a circulation by means of a pumping-over device in the cell is of considerable advantage.

With a circulation by means of a pumping-over device, the flow direction is suitably to be chosen in a way that the electrolyte enters from below into the electrode interspaces and leaves the electrode space at the top. In this manner, the separation of the gaseous phases is facilitated. The process of the invention may be described by the following reaction equation:

$$C_2F_4I_2 + HF \xrightarrow{1\ \text{Faraday}} C_2F_5J + \frac{1}{2}\,I + \frac{1}{2}\,H_2$$

With a discontinuous operation, the proportion of tetrafluoro-diiodoethane in the electrolyte naturally decreases in the course of time, whereas the concentration of perfluoroethyl iodide increases, and iodine is separated.

The molar ratio between tetrafluoro-diiodoethane and HF should be 1 : 1 as the maximum. A concentration of from 2 to 25 % by weight of tetrafluoro-diiodoethane in the electrolyte is particularly advantageous.

With a continuous operation, it is necessary to filter off the iodine being formed either periodically or continuously. With this operation, the content of tetrafluoro-diiodoethane should not be less than 10 % by weight.

The electrolyte composition, the cell temperature and the geometrical data of the cell (for example, the electrode distance and electrode thickness) are the decisive factors for the electrical resistance of the electrolyte. This resistance, the voltage applied and the effective electrode surface make up the current density (or intensity of current). In smaller units, the current density shows values of up to about 3 A per $dm^2$ of anode surface.

In principle, the process does not require the application of a determined pressure. However, the hydrofluoric acid should be present as liquid phase in the range of operation chosen. For safety reasons it is advantageous, however, to operate only at normal pressure or slight overpressure, but on principle the process may still be applied at high pressures. It is recommended in all cases to operate while using a master pressure gage and bursting membranes, since fluorine together with traces of water may form the explosive difluoroxide.

The tetrafluoro-diiodoethane used is insoluble in anhydrous hydrofluoric acid at low temperatures and therefore should not react. It was a surprising fact which could not have been foreseen that a suspension from hydrofluoric acid and tetrafluoro-diiodoethane could be brought to reaction at all, especially that the reaction comes to a stop at the step of perfluoroethyl iodide.

The iodine set free in the reaction is separated in the form of fully developed crystals. It may be filtered off from the electrolyte, for example, continuously during the electrolysis. It is also possible, however, to allow the iodine to deposit after the reaction has been completed, to drain the electrolyte off from the cell, and to remove the remaining iodine from the cell with water. The iodine obtained is pure and may be used — after the hydrofluoric acid has been washed out — for the preparation of tetrafluoro-diiodoethane from tetrafluoroethylene and iodine.

Due to the different boiling points of tetrafluoro-diiodoethane (boiling point 112° to 113° C) and perfluoroethyl iodide (boiling point 11° C), the latter can very well be separated from the tetrafluoro-diiodoethane used. However, the boiling point of perfluoroethyl iodide is very close to that of hydrofluoric acid (boiling point 19° C). Nevertheless, it has become evident that perfluoroethyl iodide may well be separated from hydrofluoric acid also in small columns. Moreover, it has been found that the iodine set free does not disturb the distillation of the perfluoroethyl iodide either, in spite of its relatively high steam pressure.

Thus, the process is preferably carried out at a temperature in the range of from +10° to +19° C, and the perfluoroethyl iodide being formed in the course of the reaction is advantageously eliminated in the gaseous state. With this operation it is recommended to provide the electrolysis cell with a reflux condenser, the cooling liquid of which reaches, or remains below, the temperature of the electrolysis cell. For example, if the electrolysis is performed at a temperature in the range of from +5° to +10° C, the condenser should advantageously be adjusted to a temperature between −5° C and +8° C. However, if the electrolysis temperature is +19° C — for example, in smaller units —, the condenser should suitably be maintained in the range of from +5° C to +11° C.

As in larger units the heat is carried off only to an insufficient degree, it is possible, if necessary, to adjust the condenser to a temperature that is still lower, or — even better — to provide larger condensers from the start. The perfluoroethyl iodide leaves the top of the reflux column in the gaseous state and is condensed in a cooling trap at a temperature of less than −10° C. The condensate is as clear as water and is practically free from hydrofluoric acid. Upon standing for some time, the perfluoroethyl iodide shows a slightly violet color.

With a small throughput, the separation of hydrofluoric acid and perfluoroethyl iodide in the reflux column is so good that the cooling trap may consist of glass. With a larger throughput, it is advantageous to insert an absorption pipe for hydrofluoric acid between the top of the column and the cooling trap, which pipe may be filled, for example, with sodium fluoride.

Test apparatus

The electrolysis cell used was made of stainless steel. Including the cooling jacket, the diameter was 15 cm and the height 20 cm. The tetrafluoro-diiodoethane was introduced via a funnel tube, and the fluorine was taken from a supply vessel for hydrofluoric acid. The top and bottom of the cell are connected by a conduit pipe, into which a vane-type pump has been inserted. Furthermore, a valve for draining the electrolyte has been included into this pump circuit. Besides, the electrolyte level in the cell may be controlled by means of an "inspection glass" of a thin-walled polytetrafluoroethylene tube. The volume of the electrolyte was about 1500 ml and was distributed onto the pump circuit and the cell interior. The temperature in the cell is controlled by two thermometers, and the temperature gage tubes are introduced into the cell from above via polytetrafluoroethylene seals. The insulated electrical feed lines, too, enter into the cell from above. The anode as well as the cathode were made of nickel and have been designed in the form of a bundle. The effective electrode surface is 20 $dm^2$ each for the anode and the cathode. The electrode distance is 3 mm, and the thickness of the individual electrode plates is 1 mm. The cell cover carries a master pressure gage and a reflux condenser having a length of about 75 cm which is intended to keep back the hydrofluoric acid. The perfluoroethyl iodide formed in the electrolysis cell is not kept back in the reflux condenser, but passes in the gaseous state into a cooling trap and is separated there in the form of a liquid. The cooling trap is cooled with acetone dry ice. The reflux condenser and the electrolysis cell are connected with two different cooling systems, the temperature of which can be chosen in each case. As cooling liquid there may be used, for example, ethanol. The cooling aggregates are those commonly used in commerce. At the top of the reflux condenser there is a bursting membrane with a minimum pressure of response of 1.5 bar.

The electrolysis current is generated by a rectifier which is provided with a voltage stabilizer to avoid mains fluctuations.

The line voltage, the intensity of current and the temperature are recorded for control by recording devices. The amount of electric energy is determined by means of an electric meter.

The following Examples serve to illustrate the invention.

EXAMPLE 1

At a temperature of −10° C, 1400 g of anhydrous hydrofluoric acid and 30 g of tetrafluoro-diiodoethane were filled into the above-described test apparatus. As the beginning of the electrolysis, the voltage was established at 7.5 V, and upon reaching the operating temperature of from +11° to 15° C, it was adjusted to values of from 5.2 to 5.4 V. The intensity of current observed was 10 A. At first, the temperature in the reflux condenser was −4° C, and after the reaction started, it was in the range of from +1° to +2° C. The test was carried on for about 19 hours. In this process, 225 Ah were consumed. From the cooling trap, 14.9 g of perfluoroethyl iodide were isolated, which corresponds to 72 % of the theory (current yield 0.7 %). The isolated perfluoroethyl iodide was analyzed by way of gas chromatography and showed a degree of purity of more than 95 % (area percent in g.c.).

EXAMPLE 2

In a manner analogous to that of Example 1, 150 g iodine tetrafluoro-diiodoethane and 1400 g of anhydrous hydrofluoric acid were introduced into the apparatus. The operating voltage was established at first at 8.1 V and was later on adjusted to 5.3 V. The intensity of current was 10A. The operating temperature of the cell was in the range of from 11° to 12° C, and that of the reflux condenser had a maximum of +3° C. The test was carried on for 31 hours. During this time 400 g of hydrofluoric acid were subsequently added in doses. The current consumption was 315 Ah. 81.9 g of pure perfluoroethyl iodide were obtained. This corresponds to 78.5 % of the theory. Furthermore, 34 g of iodide (corresponding to 93 % of the theory) was obtained. The iodine was rinsed from the cell with water. According to the analysis by gas chromatography, the degree of purity of the perfluoroethyl iodide is 97 %.

EXAMPLE 3

Use was made of a fluorination unit having a working volume of 40 l, the design of which corresponded to the test apparatus described above. 38.7 Grams of anhydrous hydrofluoric acid and 5.63 kg of tetrafluoro-diiodoethane were introduced.

The test temperature was at first 0° C, later on it was about +10° C. The electrolyte was pumped over vigorously by a centrifugal pump which was coupled magnetically. The average temperatures of the condenser were in the range of from 15° to 18° C in the entry area and from 3° to 10° C in the exit area. The average voltage was 5.5 V. In order to guarantee an even level of liquid, a total of 5.6 kg of hydrofluoric acid were subsequently added in doses. The electrolysis was carried on for 62 hours. The current consumption was 3011 Ah.

A total amount of 2689 g of crude perfluoroethyl iodide was obtained. The average degree of purity was about 95 %. Thus, the yield was approximately 2550 g of pure product, which corresponded to a theoretical yield of 65.5 % based on tetrafluoro-diiodoethane or about 9 % based on the current consumption.

We claim:

1. Process for the preparation of perfluoroethyl iodide from tetrafluoro-diiodoethane and hydrogen fluoride, which comprises electrolyzing a mixture of anhydrous hydrofluoric acid and tetrafluoro-diiodoethane at a temperature of from −15° C to +19° C at a voltage of from 3 to 8.5 using a nickel anode and recovering the formed perfluoroethyl iodide.

2. A process as claimed in claim 1, which comprises working at a voltage in the range of from 4 to 6 V.

3. A process as claimed in claim 1, which comprises stirring the mixture of hydrogen fluoride and tetrafluoro-diiodoethane thoroughly.

4. A process as claimed in claim 1, which comprises continuously filtering from the electrolyte the iodine being formed.

5. A process as claimed in claim 1, which comprises working at a temperature in the range of from +10 to +19° C and eliminating the perfluoroethyl iodide being formed in the reaction in the gaseous state.

6. A process as claimed in claim 1, wherein the mixture of anhydrous hydrofluoric acid and tetrafluoro-diiodoethane contains from 2 to 25 % by weight of tetrafluoro-diiodoethane.

* * * * *